US008979583B2

(12) United States Patent
Furuya et al.

(10) Patent No.: US 8,979,583 B2
(45) Date of Patent: Mar. 17, 2015

(54) TERMINAL-MOUNTING STRUCTURE AND TERMINAL USED IN THE SAME TERMINAL-MOUNTING STRUCTURE

(71) Applicant: Yazaki Corporation, Tokyo (JP)

(72) Inventors: Hiroyasu Furuya, Makinohara (JP); Yasutaka Nagaoka, Makinohara (JP); Norio Watanabe, Makinohara (JP)

(73) Assignee: Yazaki Corporation, Tokyo (JP)

( * ) Notice: Subject to any disclaimer, the term of this patent is extended or adjusted under 35 U.S.C. 154(b) by 35 days.

(21) Appl. No.: 13/963,944

(22) Filed: Aug. 9, 2013

(65) Prior Publication Data

US 2014/0045387 A1 Feb. 13, 2014

(30) Foreign Application Priority Data

Aug. 10, 2012 (JP) ..... 2012-178092

(51) Int. Cl.
*H01R 13/40* (2006.01)
*H01R 13/428* (2006.01)
*H01R 13/04* (2006.01)
*H01R 13/422* (2006.01)

(52) U.S. Cl.
CPC ..... *H01R 13/428* (2013.01); *H01R 13/04* (2013.01); *H01R 13/4223* (2013.01)
USPC ..... 439/595

(58) Field of Classification Search
USPC ..... 439/595, 752
See application file for complete search history.

(56) References Cited

U.S. PATENT DOCUMENTS

| | | | | |
|---|---|---|---|---|
| 7,896,696 | B2 * | 3/2011 | Hamai et al. | 439/595 |
| 2003/0220015 | A1 * | 11/2003 | Ishiyama | 439/595 |
| 2004/0259417 | A1 * | 12/2004 | Fukamachi et al. | 439/595 |
| 2006/0189219 | A1 * | 8/2006 | Yamashita et al. | 439/752 |
| 2008/0293300 | A1 * | 11/2008 | Katsuma | 439/595 |
| 2011/0143588 | A1 * | 6/2011 | Chikusa | 439/595 |

FOREIGN PATENT DOCUMENTS

| | | |
|---|---|---|
| JP | 968944 | 11/1996 |

* cited by examiner

*Primary Examiner* — Gary Paumen
(74) *Attorney, Agent, or Firm* — Locke Lord LLP

(57) ABSTRACT

The invention provides a terminal-mounting structure for mounting a terminal to a terminal-receiving portion, which includes the terminal and the terminal-receiving portion. The terminal includes an elongated plate-shaped connecting portion, a pair of wings extending from both edges of the connecting portion which are disposed in a width direction of the connecting portion and being perpendicular to the connecting portion, and a locking hole formed in the connecting portion and located between the pair of wings. The terminal-receiving portion includes a tube portion for receiving the terminal therein, and a lance capable of being locked to the locking hole of the terminal and positioned between the pair of wings. A front face of the connecting portion is not covered by the pair of wings at all. The pair of wings extends in a same direction.

5 Claims, 5 Drawing Sheets

TERMINAL-MOUNTING STRUCTURE AND TERMINAL USED IN THE SAME TERMINAL-MOUNTING STRUCTURE

CROSS-REFERENCE TO RELATED APPLICATIONS

This application claims priority from Japanese Patent Application No. 2012-178092 filed on Aug. 10, 2012.

BACKGROUND OF THE INVENTION

1. Field of the Invention

The invention relates to a terminal-mounting structure configured to attach a terminal having heat-dissipating portion to a terminal-receiving portion.

2. Background of the Invention

FIG. 6 is a perspective view of a conventional terminal having a heat-dissipating portion (see Japanese design resister No. 968944), and FIG. 7 is a cross-sectional view of a terminal-mounting structure in which the terminal of FIG. 6 is used.

With reference to FIG. 6, a terminal 302 is electrically connected to a terminal or end portion of an electrical wire 303 which at least partly defines a vehicle wiring harness. The terminal 302 is provided with an elongated plate-shaped connecting portion 321, a pair of heat-dissipating portions 322 each extending perpendicularly with respect to both edges of the connecting portion 321 which are located in a width direction of the connection portion 321, a locking hole 323 which is formed through the connection portion 321, a pair of core-caulking pieces 324 configured to caulk a core wire of the electrical wire 303, and a pair of covering-caulking pieces 325 configured to caulk an insulating covering of the electrical wire 303. In this configuration, the pair of heat-dissipating portions 322 extends in the same direction.

The connecting portion 321 is electrically connected to a terminal other than an electronic part such as fusible link or the terminal 302. The pair of heat-dissipating portions 322 is configured to dissipate heat which is created by the electrical wire 303 and the terminal 302. The pair of heat-dissipating portions 322 is inwardly bent at a right angle at its middle portion. Furthermore, there is a relatively small gap or short distance K between the tips of the pair of heat-dissipating portions 322. As shown in FIG. 7, the locking hole 323 is provided for a lance 342 to be locked thereto.

Referring to FIG. 7, in the terminal-mounting structure 301 the afore-mentioned terminal 302 is coupled or attached to a terminal-receiving portion 304. Furthermore, referring to FIG. 7, the electrical wire 303 to be electrically connected to the terminal 302 is not shown. The terminal-receiving portion 304 is provided with a tube portion 341 for receiving the terminal 302 therein, the lance 342 for locking to the locking hole 323 of the terminal 302. Furthermore, the terminal-receiving portion 304 is formed in a synthetic-resin frame 307 used for a vehicle electric junction box. In this terminal-mounting structure 301, the terminal 302 is coupled to the terminal-receiving portion 304 by locking the tip portion of the lance 342 to the locking hole 323.

However, the afore-mentioned terminal-mounting structure 301 has the following problem. When the lance 342 is intended to be locked to the locking hole 323, it is generally preferable to lock the lance 342 to the locking hole 323 from the side in which the heat-dissipating portion 322 of the connecting portion 321 vertically extends rather than the case as drawn in FIG. 7 in light of decreasing inner dimension H of the tube portion 341. However, as mentioned previously, because the pair of heat-dissipating portions 322 is inwardly bent at a right angle at its middle portion, there is only a small gap (or short distance) K between tip portions of the pair of heat-dissipating portions 322. As a result, the lance 342 cannot be passed between the tip portions of the pair of heat-dissipating portions 322. For this reason, the lance 342 cannot be locked to the locking hole 323 from the side in which the heat-dissipating portion 322 of the connecting portion 321 vertically extends, and instead, cannot but be locked to the locking hole 323 from the opposite site to the above side. In this case, the inner dimension H of the tube portion 341 accordingly increases.

SUMMARY OF THE INVENTION

The objective of the invention provides a terminal-mounting structure, which allows for space-saving of a terminal-receiving portion, and a terminal used for the terminal-mounting structure.

In order to attain the objective, the invention provides a terminal-mounting structure for mounting a terminal to a terminal-receiving portion, which includes the terminal and the terminal-receiving portion. The terminal includes an elongated plate-shaped connecting portion, a pair of wings extending from both edges of the connecting portion which are disposed in a width direction of the connecting portion and being perpendicular to the connecting portion, and a locking hole formed in the connecting portion and located between the pair of wings. The terminal-receiving portion includes a tube portion for receiving the terminal therein, and a lance capable of being locked to the locking hole of the terminal and positioned between the pair of wings. A front face of the connecting portion is not covered by the pair of wings at all. In other words, a distance between the pair of wings is not less than the width of the connecting portion. The pair of wings extends in a same direction.

In the terminal-mounting structure, the terminal-receiving portion may further include a pair of lance-protecting walls configured to position the lance therebetween and positioned between the pair of wings.

In the terminal-mounting structure, the pair of lance-protecting walls may have a tapered portion, which is configured to guide the terminal to its normal position.

In the terminal-mounting structure, the pair of wings may be inserted into the tube portion along an inner surface of the tube portion.

As another aspect of the invention, a terminal suited for used in the terminal-mounting structure as mentioned previously is also provided. The terminal includes an elongated plate-shaped connecting portion, a pair of wings extending from both edges of the connecting portion which are disposed in a width direction of the connecting portion and being perpendicular to the connecting portion, and a locking hole formed in the connecting portion and located between the pair of wings. A front face of the connecting portion is not covered by the pair of wings at all. The pair of wings extends in a same direction.

DETAILED DESCRIPTION OF THE INVENTION

With reference to FIGS. 1-5, one embodiment of a terminal-mounting structure in accordance with the invention and a terminal used in the one embodiment of the terminal-mounting structure will be hereinafter described in detail.

Figure 2:
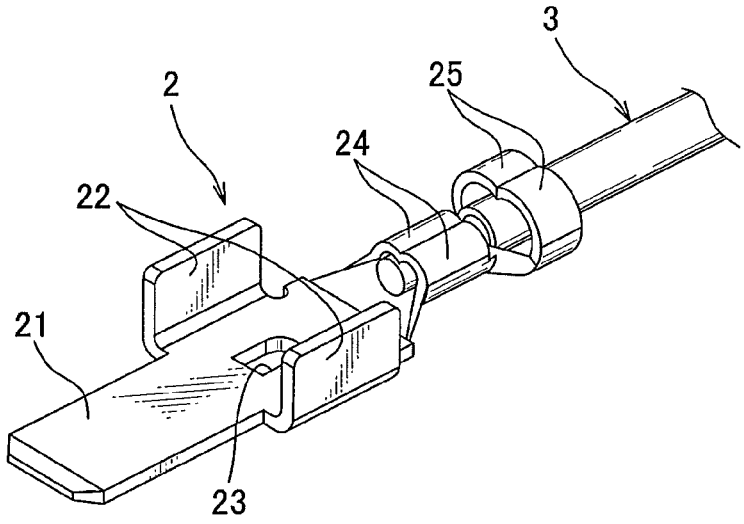
FIG. 2 shows a perspective view of a terminal used in the terminal-mounting structure of FIG. 1.
Figure 3:
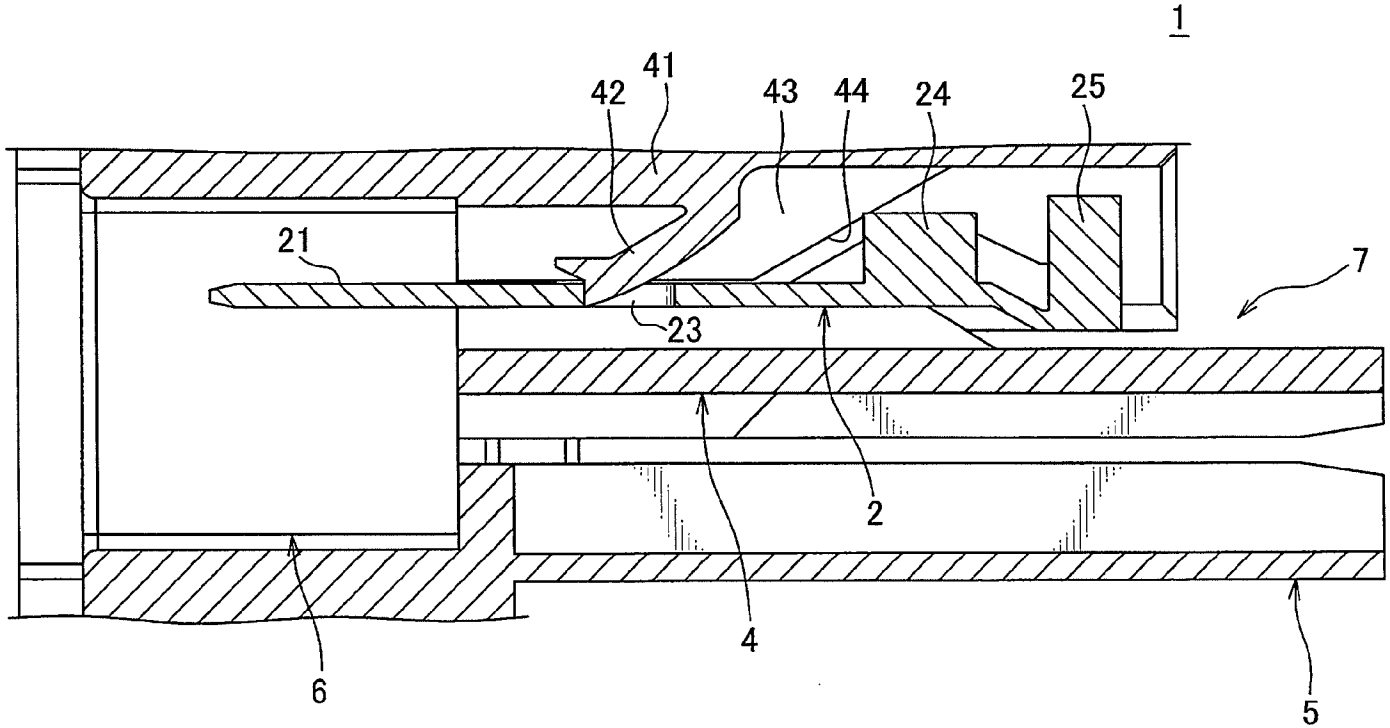
FIG. 3 is a cross-sectional view of the terminal-mounting structure of FIG. 1 along the line A-A.
Figure 4:
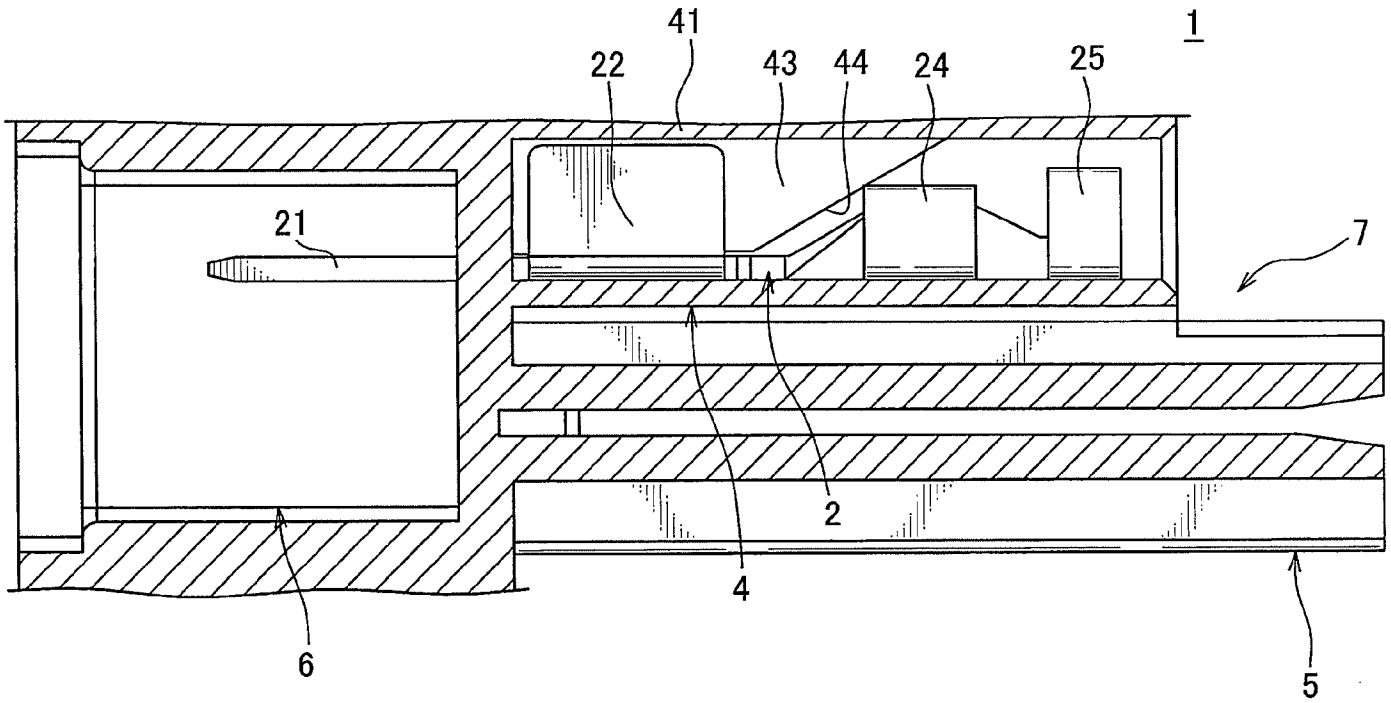
FIG. 4 is a cross-sectional view of the terminal-mounting structure of FIG. 1 along the line B-B.

Referring to FIGS. 3 and 4, a terminal-mounting structure 1 is provided to attach or couple a terminal 2 to a terminal-receiving portion 4. Referring to FIG. 2, the terminal 2 is electrically connected to a terminal or end portion of an electrical wire which constitutes vehicle wiring harness. In FIGS. 3 and 4, an electrical wire 3 to be electrically connected to the terminal 2 is not shown. A terminal-receiving portion 4 is mounted to a frame 7, which is used for a vehicle electric junction box. The frame 7 is formed of synthetic polymer composition, and includes a bus bar-receiving portion 5 for mounting a bus bar therein, a part-receiving portion 6 for mounting a part such as a fusible link therein, and etc. in addition to the terminal-receiving portion 4. FIGS. 1, 3-5 depict not an overall of the frame 7 but a part of the frame 7.

The terminal 2 can be obtained by, for example, pressing a metallic plate. The terminal 2 is provided with an elongated plate-shaped connecting portion 21, a pair of wings 22 extending from both edges or ends of the connecting portion 21 which are disposed in a width direction of the connecting portion 21, and being perpendicular to the connecting portion 21, a locking hole (through-hole) 23 formed in the connecting portion 21 and is disposed between the pair of wings 22, a pair of core-caulking pieces 24 configured to caulk a core wire of the electrical wire 3, and a pair of covering-caulking pieces 25 configured to caulk an insulating covering of the electrical wire 3. In this configuration, the pair of wings 22 extends from each edge of the connecting portion 21 in a same direction.

A tip portion of the connecting portion 21 is electrically connected to a fusible link, which is coupled or attached to a part-receiving portion 6. The pair of wings 22 is configured to dissipate heat which is created by the terminal 2 and the electrical wire 3. The pair of wings 22 is perpendicular to the connecting portion 21. Furthermore, there is totally opened between the pair of wings 22. In other words, the front surface of the connecting portion 21 is not covered by the pair of wings 22 at all. The tip portion of a lance 42 of the terminal-receiving portion 4 is locked to the locking hole 23.

Figure 1:
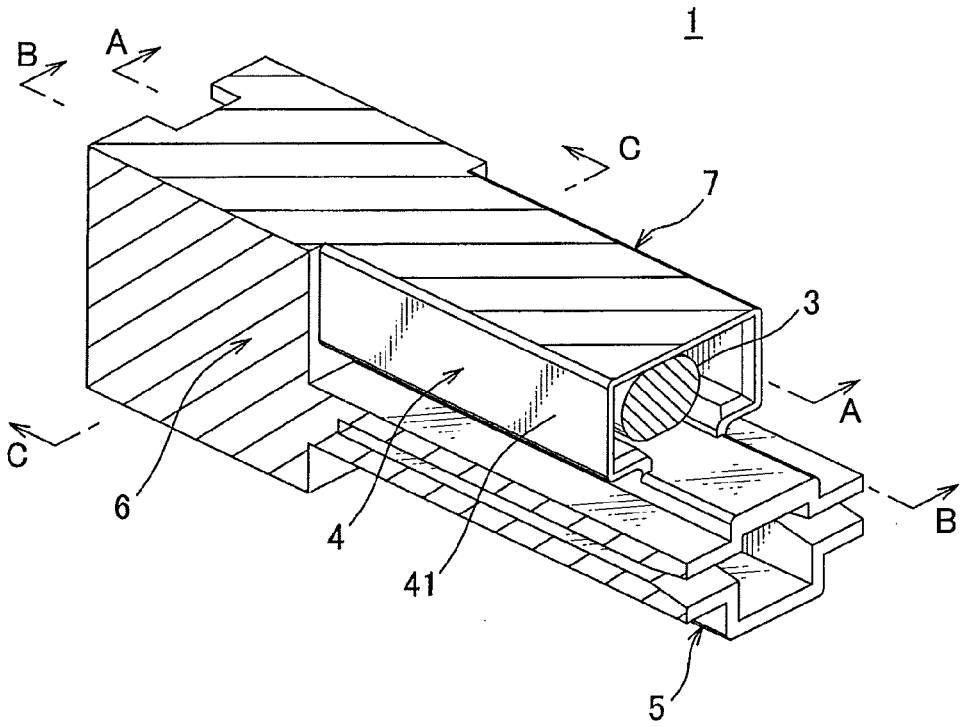
FIG. 1 shows a perspective view of a terminal-mounting structure in accordance with one embodiment of the invention.
Figure 5:
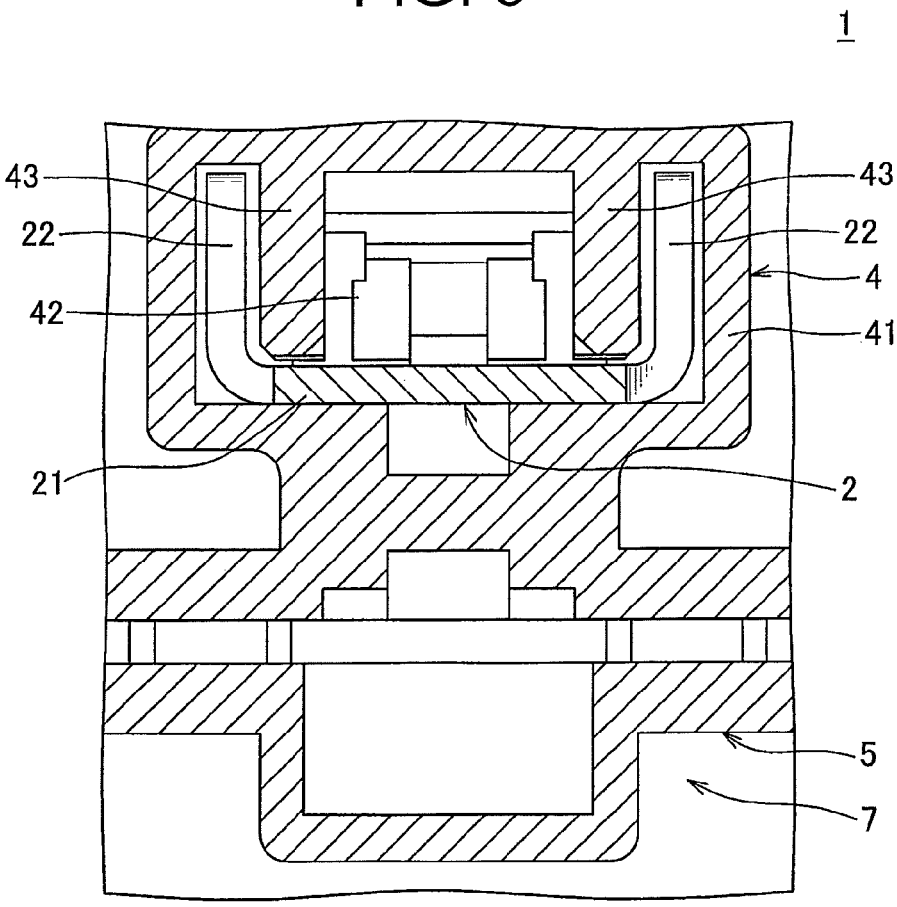
FIG. 5 is a cross-sectional view of the terminal-mounting structure of FIG. 1 along line C-C.
Figure 6:
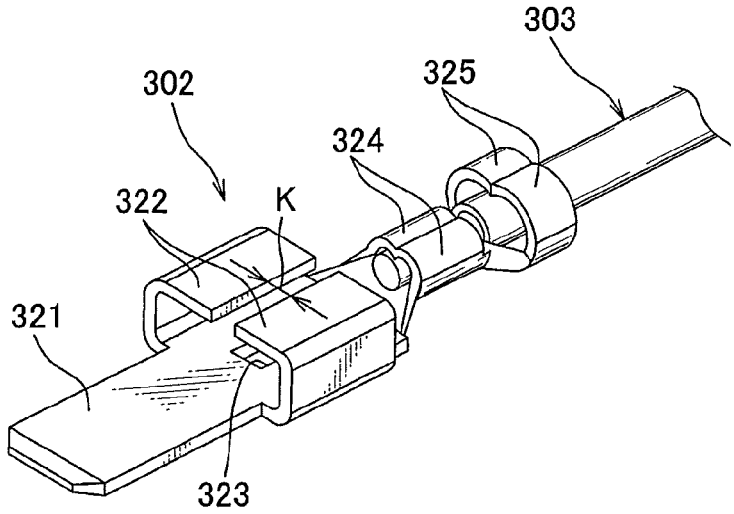
FIG. 6 (PRIOR ART)
FIG. 6 is a perspective view of a conventional terminal.
Figure 7:
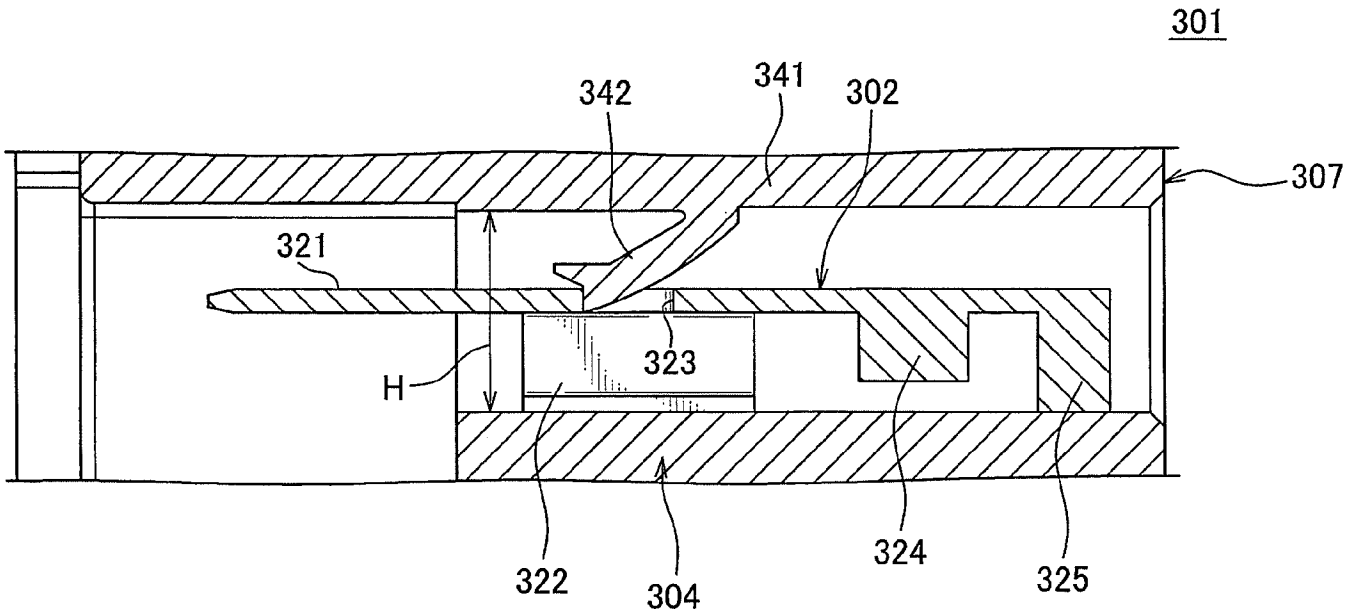
FIG. 7 (PRIOR ART)
FIG. 7 is a cross-sectional view of a terminal-mounting structure in which the terminal of FIG. 6 is used.

Referring to FIGS. 1 and 5, the terminal-receiving portion 4 includes a tube portion 41 configured to receive the terminal 2 therein, the lance 42, which is locked to the locking hole 23 of the terminal 2 and is disposed between the pair of wings 22, and a pair of lance-protecting walls 43 configured to position the lance 42 therebetween and located between the pair of wings 22.

The tube portion 41 is angular tube-shaped. Referring to FIG. 3, one end of the tube portion 41 communicates with the part-receiving portion 6. The other end of the tube portion 41 corresponds to a terminal inlet through which the terminal 2 is inserted.

Referring to FIGS. 3 and 4, each of the pair of the lance-protecting walls 43 is provided with a tapered portion 44, which is configured to guide the terminal 2 to a normal position. The tapered portion 44 is formed at the end of the lance-protecting wall 43 adjacent to the terminal inlet. The tapered portion 44 is inclined away from the inner surface of the tube portion 41 communicating with the lance-protecting wall 43 of the tube portion 41, as going toward the part-receiving portion 6 side away from the terminal insert side.

When attaching the terminal 2 is intended to be attached to the terminal-receiving portion 4, the core wire of the electrical wire 3 is caulked by the pair of core-caulking pieces 24 and the insulating covering of the electrical wire 3 is caulked by the pair of covering-caulking piece 25 in advance so that the terminal 2 is attached to the end or terminal of the electrical wire 3. Subsequently, the terminal 2 is inserted from the connecting portion 21 into the tube portion 41. As such, the terminal 2 is inserted into the tube portion 41 so that the tip portion of the lance 42 is locked to the locking hole 23 of the terminal 2, and terminal 2 is then attached or coupled to the terminal-receiving portion 4. Furthermore, while the lance 42 locked to the locking hole 23, the tip portion of the connecting portion 21 is located inside the part-receiving portion 6.

When the terminal 2 is inserted into the tube portion 41, the tip portion of the connecting portion 21 slides on the tapered portion 44 of the lance-protecting portion 43 so that the terminal 2 is smoothly guided to its normal position. Accordingly, the tip portion of the connecting portion 21 is avoided to collide against the lance 42, and thus possible breakage or damage of the lance 42 can be effectively avoided. Moreover, the pair of the wings 22 is inserted into the tube portion 41 along the inner surface of the tube portion 41 so that the terminal 2 can be inserted into the tube portion 41 in a smooth manner. In other words, the pair of wings 33 is configured to guide the terminal 2 to insert into the tube portion 41.

Moreover, the terminal 2 is erroneously inserted into the tube portion 41 upside down, the tip portion of the connecting portion 21 abuts against the tapered portion 44 of the lance-protecting portion 43 during the insertion of the terminal 2, thereby not allowing the terminal to progress any further. Accordingly, erroneous insertion of the terminal 2 into the tube portion 41 can be effectively prevented. As such, due to the presence of the lance-protecting wall 43 the tip portion of the connecting portion 21 is avoided to collide against the lance 42, and breakage or damage of the lance 42 is thus avoided.

As described previously, due to the terminal-mounting structure 1 the lance 42 can be located between the pair of wings 22. As a result, as shown in FIG. 4, the inner dimension of the tube 41 can be suppressed to the height of the wing 22, thereby allowing the size of the terminal-receiving portion 4 to be reduced.

While the afore-mentioned examples is directed to a case in which the terminal-mounting structure 1 is applied to a vehicle electric junction box, the terminal-mounting structure 1 can be applied to a connector or other electrical or electronic devices other than the vehicle electric junction box.

The present invention has been described in terms of one or more preferred embodiments, and it should be appreciated that many equivalents, alternatives, variations, and modifications, aside from those expressly stated, are possible and within the scope of the invention.

The invention claimed is:

1. A terminal-mounting structure for mounting a terminal to a terminal-receiving portion, comprising:

the terminal having an elongated plate-shaped connecting portion, a pair of wings extending from both edges of the connecting portion which are disposed in a width direction of the connecting portion and being perpendicular to the connecting portion, and a locking hole formed in the connecting portion and located between the pair of wings; and the terminal-receiving portion having a tube portion for receiving the terminal therein, and a lance capable of being locked to the locking hole of the terminal and positioned between the pair of wings, wherein a front face of the connecting portion is not covered by the pair of wings and wherein the pair of wings extends in a same direction.

2. The terminal-mounting structure as claimed in claim 1, wherein the terminal-receiving portion further includes a pair of lance-protecting walls configured to position the lance therebetween and positioned between the pair of wings.

3. The terminal-mounting structure as claimed in claim 2, wherein the pair of lance-protecting walls has a tapered portion, which is configured to guide the terminal to its normal position.

4. The terminal-mounting structure as claimed in claim 1, wherein the pair of wings is inserted into the tube portion along an inner surface of the tube portion.

5. A terminal being suited for used in the terminal-mounting structure as claimed in claim 1, comprising:

an elongated plate-shaped connecting portion;

a pair of wings extending from both edges of the connecting portion which are disposed in a width direction of the connecting portion and being perpendicular to the connecting portion; and a locking hole formed in the connecting portion and located between the pair of wings, wherein a front face of the connecting portion is not covered by the pair of wings and wherein the pair of wings extends in a same direction.

* * * * *